US005765480A

United States Patent [19]

Toyoda

[11] Patent Number: 5,765,480

[45] Date of Patent: Jun. 16, 1998

[54] WIPING DEVICE OF INTAGLIO PRINTING PRESS

[75] Inventor: Hideaki Toyoda, Higashikatsushika-gun, Japan

[73] Assignee: Komori Corporation, Tokyo, Japan

[21] Appl. No.: 721,960

[22] Filed: Sep. 27, 1996

[30] Foreign Application Priority Data

Sep. 27, 1995 [JP] Japan ..... 7-248977

[51] Int. Cl.[6] ..... B41F 9/10

[52] U.S. Cl. ..... 101/169; 101/154; 101/157

[58] Field of Search ..... 101/169, 154, 101/157

[56] References Cited

U.S. PATENT DOCUMENTS

| | | | |
|---|---|---|---|
| 509,528 | 11/1893 | Harper | 101/157 |
| 3,252,416 | 5/1966 | Allen | 101/169 |
| 3,593,663 | 7/1971 | Vischulis | 101/157 |
| 3,780,670 | 12/1973 | Abler et al. | 101/169 |

FOREIGN PATENT DOCUMENTS

| | | |
|---|---|---|
| 357825 | 3/1990 | European Pat. Off. . |
| 703738 | 2/1941 | Germany . |
| 7-47306 | 3/1987 | Japan . |
| 187291 | 10/1922 | United Kingdom . |

*Primary Examiner*—Edgar S. Burr
*Assistant Examiner*—Amanda B. Sandusky
*Attorney, Agent, or Firm*—Birch, Stewart, Kolasch & Birch, LLP

[57] ABSTRACT

In a wiping device of an intaglio printing press in which a doctor blade can follow the movement of a wiping roller through a cam mechanism, a holder for the doctor blade is supported on a tank on the machine body side by long holes, formed in the holder in its right-and-left direction and elongated in its back-and-forth direction, and flanged pin members, passing through the long holes, so as to be movable in the directions of throw-on and throw-off movement of the doctor blade. The rightward and leftward movements of the holder are restrained by the long hole and pin member located at one site in the center of the holder. Thus, the doctor blade can fully follow the cocking of the wiping roller, and there are no problems due to the penetration of a solvent or ink.

4 Claims, 4 Drawing Sheets

WIPING DEVICE OF INTAGLIO PRINTING PRESS

BACKGROUND OF THE INVENTION

1. Field of the Invention

This invention relates to a wiping device of an intaglio printing press which, after each printing, wipes off the surplus part of ink supplied to an intaglio surface which adheres to sites other than patterns.

2. Description of the Related Art

An intaglio printing press has an intaglio cylinder having an intaglio mounted on the peripheral surface thereof, and an impression cylinder contiguous to the intaglio cylinder. A paper to be printed is fed by a feeder, transported to a swing arm shaft pregripper, and then gripped by a gripper of the impression cylinder. The paper is printed with ink supplied to the plate surface of the intaglio to have images transferred thereto. A printed paper is delivered by a discharge chain for discharge.

This type of intaglio printing press is equipped with a wiping device as disclosed, for example, in Japanese Patent Publication No. 47306/95. This wiping device comprises a wiping roller contiguous to the intaglio cylinder, and rotating such that the contiguous peripheral surfaces of the wiping roller and the intaglio cylinder move in opposite directions to each other; a plurality of brushes each having a pad surface contiguous to the peripheral surface of the wiping roller; and a doctor blade located downstream from the brushes in the direction of roller rotation and having a front end in contact with the wiping roller, the doctor blade being formed in the shape of a plate from an elastic material such as synthetic rubber. Part of the ink supplied from ink form rollers of an inking device to an intaglio surface migrates and adheres to the surroundings of the ink-retaining cups as patterns. This surplus part of the ink is wiped off with the wiping roller rotating in contact with the plate surface, and only the patterns of the cups are transferred to a paper. The wiping roller is rotating while being dipped in a solvent contained in a tank, such as trichloroethylene. The ink passed on to the wiping roller by the wiping-off action is removed with this solvent in combination with the washing action of the brushes. The solvent carried by the wiping roller is scraped off with the doctor blade into the solvent tank.

With the ink wiping-off action by the wiping device, if the contact pressure of the wiping device on the plate surface is too high, the ink of the cups as patterns will be scraped off with the result that very thin lines cannot be printed. If the contact pressure is too low, surplus ink will remain in the surroundings of the cups. This will make the line widths of images wide, resulting in bleeding prints, or will cause the ink to remain in the non-image areas, leaving considerable smears. To ensure the quality of prints, it is necessary to adjust the contact pressure of the wiping roller on the plate surface accurately. A conventional wiping device has a contact pressure adjusting device for this purpose. This type of conventional device for adjusting the contact pressure of a wiping roller journals the wiping roller by eccentric bearings, and turns these eccentric bearings by hydraulic cylinders, or turns the wiping roller by a handle device via a worm and a worm wheel, or via a screwed shaft, to move the wiping roller slightly toward and away from the plate surface. Another problem has been that if the contact pressure of the doctor blade is too high, the wiping roller will be damaged. If it is low, the solvent cannot be scraped off completely. In this case, the solvent may transfer from the wiping roller to the intaglio surface, and dissolve the ink adhering onto the intaglio surface, causing printing problems. Thus, it has been customary practice to provide a handle-operated contact pressure adjusting device for moving the tip of the doctor blade to and from the peripheral surface of the wiping roller. These two devices for adjusting contact pressure are used for throw-on and throw-off movement among the intaglio surface, the wiping roller, and the doctor blade.

In a conventional wiping device, as shown in FIG. 5 and FIG. 7, a holder 2 for holding a doctor blade 1 is supported on an upper edge portion of a tank 3, a support on the machine body side, by a dovetail groove 4*a* formed on the holder 2 side and a dovetail groove 4*b* formed on the tank 3 side. The holder 2 is supported there so as to be movable in the directions of throw-on and throw-off movement of the doctor blade 1 with respect to the wiping roller 5. The holder 2 is connected by a cam mechanism 7 to eccentric bearings 6 which support the wiping roller 5. That is, a lever 7*c* engaging a grooved cam 7*a*, formed on the eccentric bearing 6 side, via a straight pin 7*b* is secured to the holder 2. Thus, when the eccentric bearings 6 are rotated to adjust the contact pressure of the wiping roller 5 on the plate surface, the doctor plate 1 is moved in the directions of throw-on and throw-off movement to and from the wiping roller 5 in an interlocked relationship with the cam mechanism 7 to make the contact pressure of the doctor blade 1 on the wiping roller 5 constant.

With the conventional wiping device, however, the doctor blade 1 has only a linear motion because of the dovetail groove 4*a* formed on the holder 2 side and the dovetail 4*b* formed on the tank 3 side. Moreover, the cam follower used is the straight pin 7*b*. Thus, the following problems have been involved:

(1) If the wiping roller is subjected to skewing adjustment by the rotation of one of the eccentric bearings, the cam follower and the doctor blade are unable to follow the cocking, because they cannot move obliquely. Consequently, the doctor blade may move dully, and the parts may be broken.

(2) The first problem (1) occurs when the right and left hydraulic cylinders fail to move synchronously with the same phase during the throw-on and throw-off movement of the wiping roller.

SUMMARY OF THE INVENTION

It is an object of the present invention to provide a wiping device of an intaglio printing press in which a doctor blade can fully follow cocking of a wiping roller.

To attain this object, the present invention is designed to have a wiping roller supported so as to be movable such that its peripheral surface contacts and leaves an intaglio surface on an intaglio cylinder, and supported so as to be capable of skewing adjustment relative to the intaglio surface. The present invention further includes: a holder for holding a doctor blade having a tip to be contacted with the peripheral surface of the wiping roller, the holder being supported movably on the machine body side; an interlocking mechanism connected to the wiping roller side such that the holder moves following the movement of the wiping roller; and a holder support means for supporting the holder on the machine body side such that the holder can move toward and away from the wiping roller and can turn following a skewing motion of the wiping roller, the holder support means being adapted to restrain the movement of the holder in the right-and-left direction.

According to this design, the doctor blade can make a swinging (oblique) motion in addition to a linear motion. Its swing enables the doctor blade to follow the cocking movement of the wiping roller.

Another aspect of the present invention is a wiping device of an intaglio printing press which comprises: a wiping roller movable such that its peripheral surface contacts and leaves an intaglio surface on an intaglio cylinder; a doctor blade held on a holder such that the tip of the doctor blade releasably contacts the peripheral surface of the wiping roller, the holder being supported on the machine body side so as to be movable in the directions of throw-on and throw-off of the doctor blade, and being connected to the wiping roller side by an interlocking mechanism such that the holder advances and retreats following the movement of the wiping roller; wherein the holder is supported on the machine body side by means of either a plurality of long holes or a plurality of long grooves and pin members so as to be movable in the directions of throw-on and throw-off movement of the doctor blade, the long holes or long grooves being formed in the holder in its right-and-left direction and elongated in its back-and-forth direction; the long grooves being each closed at the front end surface thereof, and the pin members passing through the long holes or long grooves; and the movement of the holder in the right-and-left direction is restrained by the long hole or long groove and the pin member that are located at one site in the center of the holder.

According to the above aspect of the invention, this simple configuration enables the doctor blade to make a swinging (oblique) motion in addition to a linear motion. This swing permits the doctor blade to follow the cocking of the wiping roller.

The interlocking mechanism is a cam mechanism. Preferably, a spherical roller is used as the cam follower on the holder side that engages the grooved cam on the eccentric bearing side. By so doing, the cam follower can fully respond to the cocking of the wiping roller, thus preventing an unwanted force.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the following detailed description in conjunction with the accompanying drawings which are given for the purpose of illustration only, and thus are not limitative, and wherein.

DETAILED DESCRIPTION OF THE PREFERRED EMBODIMENTS

Figure 5:
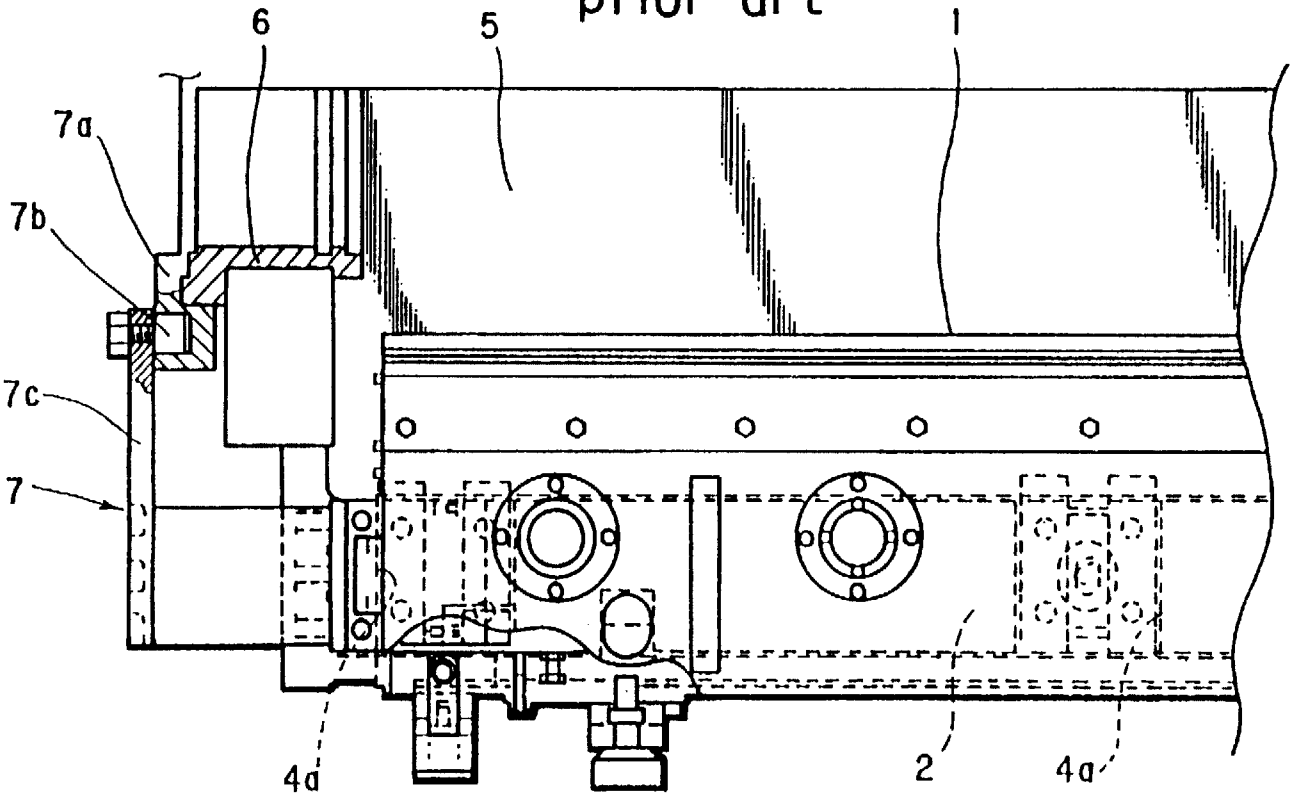
Fig.5 prior art
FIG. 5 is a plan view of an essential part of a conventional wiping device.
Figure 6:
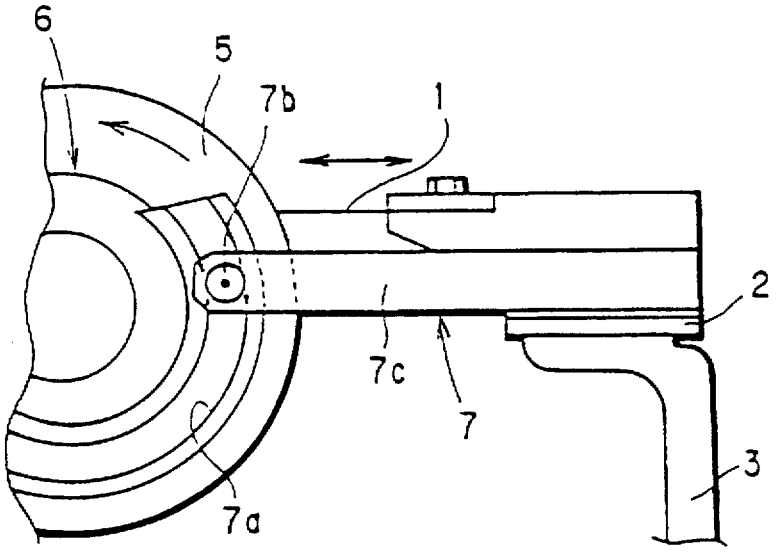
Fig.6 prior art
FIG. 6 is a side view of the essential part of the conventional wiping device.
Figure 7:
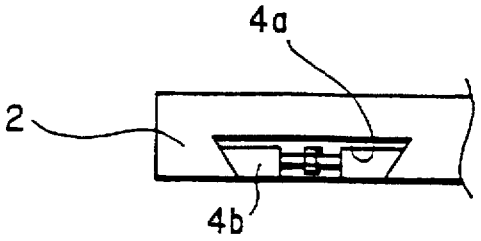
Fig.7 prior art
FIG. 7 is a detail view of a sliding portion of a holder in the conventional wiping device.

An embodiment of a wiping device of an intaglio printing press concerned with the present invention will be described by reference to FIG. 1 to FIG. 4, in which the same members as in FIG. 5 to FIG. 7 are assigned the same numerals, and overlapping explanations are omitted.

The illustrated embodiment shows a wiping device of an intaglio printing press, which has a wiping roller 5 journaled in inner holes of right and left eccentric bearings 6 to permit movement such that the peripheral surface of the wiping roller 5 contacts and leaves an intaglio surface (not shown) on an intaglio cylinder as the eccentric bearings 6 turn; and a doctor blade 1 held on a holder 2 such that the tip of the doctor blade 1 releasably contacts the peripheral surface of the wiping roller 5. The holder 2 is supported on a tank 3 on the machine body side so as to be movable in the directions of throw-on and throw-off movement of the doctor blade 1 and the eccentric bearings 6 and the opposite ends of the holder 2 are connected together by a cam mechanism 7 such that the holder 2 advances and retreats following the turns of the eccentric bearings 6.

In the instant embodiment, the holder 2 is supported on an upper surface of the tank 3 on the solvent 15 departing side of the wiping roller 5 by means of a plurality of (three in the drawing) long holes 10 formed with a predetermined spacing in the right-and-left direction and elongated in the back-and-forth direction, and by means of flanged pins 11 passing through these long holes 10. Thus, the holder 2 can move in directions with throw-on and throw-off movement relative to the doctor blade 1, and can be prevented from floating from the tank 3. The long hole 10 and the flanged pin 11 located at one site in the center of the holder 2 restrain the movement of the holder 2 in the right-and-left direction. The long holes 10 and the flanged pins 11 other than those located at the one site in the center are constructed such that the flanged pin 11 has a smaller diameter than the minor diameter of the long hole 10. Thus, those other flanged pins 11 are fitted into those other long holes 10 with some play, so that they enable the holder 2 to move forward and backward (straightly) with some rightward and leftward play. The holder 2 is also adapted to advance and retreat in an interlocked relationship with the throw-on and throw-off movement of the wiping roller 5 to and from an intaglio cylinder 13 under the action of the cam mechanism 7. The cam mechanism 7 uses a spherical roller **7*d* as a cam follower at the front end of a lever 7*c* on the holder 2 side which engages a grooved cam 7*a* on the eccentric bearing 6 side. A sliding portion of the spherical roller 7*d*** is surface treated with a self-lubricating rust preventive agent (e.g., chemical plating with TEFLON™ Composite Nickel).

Figure 1:
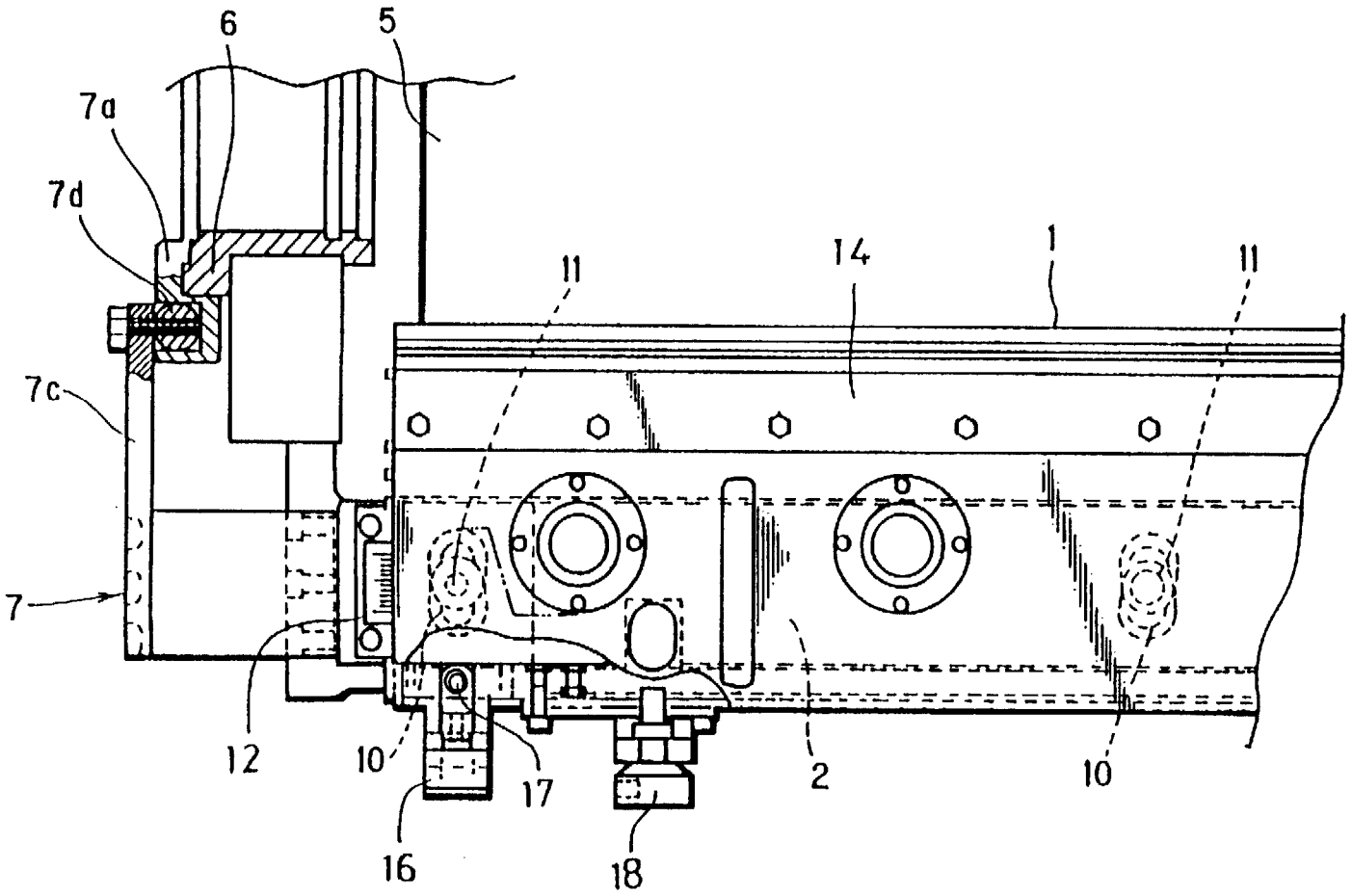
FIG. 1 is a plan view of an essential part of a wiping device drawn to an embodiment of the present invention.
Figure 2:
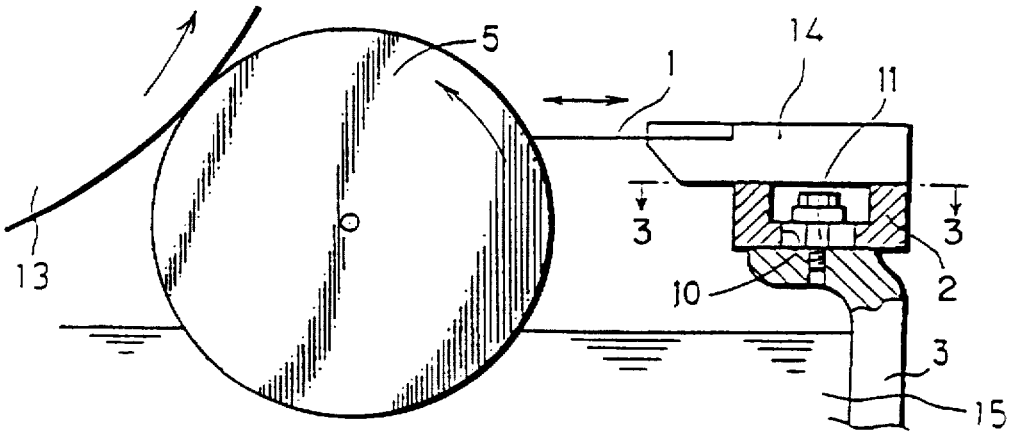
FIG. 2 is a side view of the essential part of the wiping device.
Figure 3:
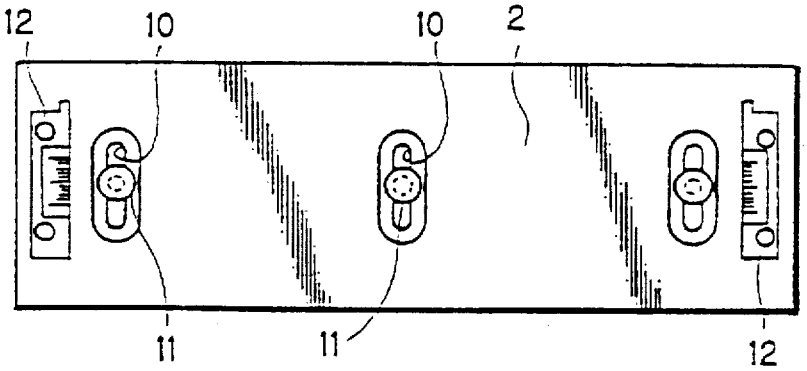
FIG. 3 is a view taken on line A—A of FIG. 2.
Figure 4:
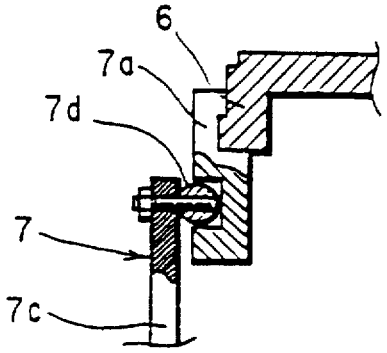
FIG. 4 is a sectional view of an essential part of a cam mechanism in the wiping device.

A hydraulic cylinder 16 is attached to the holder 2, and an actuator portion of the hydraulic cylinder 16 is connected to the doctor 14 by a pin 17. Upon actuation of the hydraulic cylinder 16, the doctor 14 moves with respect to the holder 2, whereupon the doctor 14 can advance toward and retreat from the wiping roller 5 independently. The doctor 14 also moves with respect to the holder 2 by use of a threaded handle 18. Thus, the doctor 14 can be manually made to advance toward and retreat from the wiping roller 5. To the doctor 14, a doctor blade 1 as a blade extending along the axial direction of the wiping roller 5 is fixed, and is adapted to contact the peripheral surface of the wiping roller 5. By operating the threaded handle 18, the doctor 14 is moved, thereby adjusting the gap between the doctor blade 1 and the wiping roller 5. In FIG. 3, the numeral 12 denotes a scale for use in fine adjustment of the gap by operating the threaded handle 18. A pointer (not shown) on the doctor 14 in combination with the scale enables the operator to make fine adjustment of the amount of the gap.

According to the above-described configuration, when the nip pressure between the intaglio cylinder and the wiping roller 5 is adjusted, the holder 2 moves with respect to the tank 3 in the directions of throw-on and throw-off movement of the doctor blade 1 via the cam mechanism in accordance with the turns of the right and left eccentric bearings 6. Thus, the pressure of contact between the wiping roller 5 and the doctor blade 1 does not change.

When the wiping roller 5, for example, on the operator's side of the printing press is to be cocked, the spherical roller 7*d* on the operator's side can be cocked about the spherical roller 7*d* on the drive side by moving the grooved cam 7*a* of the eccentric bearing 6 turned by the actuation of the hydraulic cylinder on the operator's side. On this occasion, the doctor blade 1 also moves obliquely and follows the above cocking motion, because of the aforementioned designs of the long holes 10 and flanged pins 11.

As noted above, the doctor blade 1 can satisfactorily follow the cocking of the wiping roller 5, thus completely preventing changes in the contact pressure or damage to parts owing to holdback of the movement of the doctor blade 1. With a conventional configuration, the solvent or ink may penetrate through the opening of the dovetail groove, solidify or dry, holding back the movement of the doctor blade. According to the configuration of the instant embodiment, on the other hand, the holder has no opening. Thus, the penetration of the solvent or ink into the sliding surfaces can be prevented, whereby the holdback of slides can be inhibited and maintenance becomes easier. Furthermore, the sliding portion of the spherical roller 7*d* is surface treated to impart anticorrosive and self-lubricating properties. This facilitates cleaning of ink and smoothes slides.

In the foregoing embodiment, the eccentric bearings and the holder are interlocked using the cam mechanism. However, any interlocking mechanism other than the cam mechanism may be used for interlock. The long holes formed at three spaced locations of the holder in its right-and-left direction and elongated in the back-and-forth direction of the holder, and the flanged pins passing through these long holes need not be provided on the right and left sides. It is permissible to provide a pin in the holder, and form an elongated hole in the tank. Alternatively, an elongated hole closed at its top may be provided in the holder, and a pin may be provided in the tank. The pin may be a straight pin, and need not be situated at the center. Instead of the long holes, long grooves each closed at the front end surface may be formed in the holder.

As described above, the present invention can provide a wiping device of an intaglio printing press which has a wiping roller supported so as to be movable such that its peripheral surface contacts and leaves an intaglio surface on an intaglio cylinder, and supported so as to be capable of skewing adjustment relative to the intaglio surface. The present invention includes a holder for holding a doctor blade having a tip to be contacted with the peripheral surface of the wiping roller, the holder being supported movably on the machine body side; an interlocking mechanism connected to the wiping roller side such that the holder moves following the movement of the wiping roller; and a holder support means for supporting the holder on the machine body side such that the holder can move toward and away from the wiping roller and can turn following a skewing motion of the wiping roller. The holder support means is adapted to restrain the movement of the holder in the right-and-left direction. This wiping device enables the doctor blade to follow the cocking of the wiping roller easily, and is free from possible troubles due to the penetration of the solvent or ink.

As another aspect of the invention, there can be provided a wiping device of an intaglio printing press in which a doctor blade can follow the movement of a wiping roller through an interlocking mechanism. In this wiping device, the holder is supported on the machine body side by means of either a plurality of long holes or a plurality of long grooves and pin members so as to be movable in the directions of throw-on and throw-off of the doctor blade. The long holes or long grooves are formed in the holder in its right-and-left direction and elongated in its back-and-forth direction and the long grooves are each closed at the front end surface thereof. The pin members pass through the long holes or long grooves and the movement of the holder in the right-and-left direction is restrained by the long hole or long groove and the pin member that are located at one site in the center of the holder. Thus, a simple configuration enables the doctor blade to follow the cocking of the wiping roller easily, and the wiping device is free from troubles due to the penetration of the solvent or ink.

If a cam mechanism is used as the interlocking mechanism, and a spherical roller is used as the holder-side cam follower that engage the eccentric bearing-side grooved cam the cam follower can respond to the cocking of the wiping roller, thus preventing an unwanted force.

While the present invention has been described in the foregoing fashion, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the following claims.

What is claimed is:

1. A wiping device of an intaglio printing press, comprising:

a wiping roller supported so as to be movable such that the peripheral surface of said wiping roller contacts and leaves an intaglio surface on an intaglio cylinder, and supported so as to be capable of skewing adjustment relative to said intaglio surface;

a holder for holding a doctor blade having a tip to be contacted with the peripheral surface of said wiping roller, said holder being supported movably on a machine body side;

an interlocking mechanism connected to a wiping roller side such that said holder moves following the movement of said wiping roller; and holder support means for supporting said holder on the machine body side such that said holder can move toward and away from said wiping roller and can turn following a skewing motion of said wiping roller, said holder support means being adapted to restrain the movement of said holder in a right-and-left direction, the right-and-left direction being substantially perpendicular to the holder movement toward and away from said wiping roller.

2. The wiping device of claim 1, wherein said interlocking mechanism is a cam mechanism comprising a grooved cam on an eccentric bearing side, and a spherical roller used as a cam follower on a holder side, said cam follower engaging said grooved cam.

3. A wiping device of an intaglio printing press, comprising:

a wiping roller movable such that its peripheral surface contacts and leaves an intaglio surface on an intaglio surface on an intaglio cylinder;

an interlocking mechanism; and a doctor blade held on a holder such that the tip of the doctor blade releasably contacts the peripheral surface of said wiping roller, said holder being supported on a machine body side so as to be movable in the directions of throw-on and throw-off movement of said doctor blade, and being connected to a wiping roller side by said interlocking mechanism such that said holder advances and retreats following the movement of said wiping roller; wherein said holder is supported on the machine body side by means of either a plurality of long holes or a plurality of long grooves and pin members so as to be movable in the directions of throw-on and throw-off movement of said doctor blade, said long holes or long grooves being formed in said holder in a lateral direction and elongated in a front-to-back direction, said long holes or long grooves being each closed at the front end surface thereof, and said pin members passing through said long holes or long grooves; one of the long holes or long grooves and one of the pin members are located at a center of said holder and restrain movement of said holder in the lateral direction while remaining lone holes or long grooves and pin members located other than at the center guide said holder in both the lateral direction and the front-to-back direction, the lateral direction being substantially perpendicular to the front-to-back direction.

4. The wiping device of claim 3, wherein said interlocking mechanism is a cam mechanism comprising a grooved cam on an eccentric bearing side, and a spherical roller used as a cam follower on a holder side, said cam follower engaging said grooved cam.

* * * * *

UNITED STATES PATENT AND TRADEMARK OFFICE

CERTIFICATE OF CORRECTION

PATENT NO. : 5,765,480

DATED : June 16,1998

INVENTOR(S) : Hieaki Toyoda

It is certified that error appears in the above-identified patent and that said Letters Patent is hereby corrected as shown below:

Column 3 line 60, please delete "A-A" and insert --3-3--.

Signed and Sealed this

Ninth Day of February, 1999

*Attest:*

*Acting Commissioner of Patents and Trademarks*

*Attesting Officer*